US005207327A

United States Patent [19]

Brondos

[11] Patent Number: 5,207,327

[45] Date of Patent: May 4, 1993

[54] FOLDABLE PACKAGING CUSHION FOR PROTECTING ITEMS

[75] Inventor: Theodore A. Brondos, Santa Cruz, Calif.

[73] Assignee: Maxtor Corporation, San Jose, Calif.

[21] Appl. No.: 792,232

[22] Filed: Aug. 3, 1992

Related U.S. Application Data

[63] Continuation of Ser. No. 630,283, Dec. 19, 1990, abandoned.

[51] Int. Cl.[5] ..... B65D 81/02

[52] U.S. Cl. ..... 206/523; 206/521; 206/591; 206/592

[58] Field of Search ..... 206/453, 521, 523, 524, 206/586, 591, 592; 229/DIG. 1

[56] References Cited

U.S. PATENT DOCUMENTS

| | | | |
|---|---|---|---|
| 3,565,243 | 2/1971 | Freeman | 206/523 |
| 3,580,469 | 5/1971 | Reese | 206/523 |
| 3,596,830 | 8/1971 | McFarland | 206/521 |
| 3,854,650 | 12/1974 | Hanaue | 206/523 |
| 3,994,433 | 11/1976 | Jenkins et al. | 206/586 |
| 4,122,946 | 10/1978 | Holley | 206/523 |
| 4,709,817 | 12/1987 | Keady et al. | 206/523 |
| 4,840,277 | 6/1989 | Waldner | 206/523 |
| 4,892,193 | 1/1990 | Thomas | 206/453 |
| 4,972,954 | 11/1990 | Dickie | 206/523 |
| 5,024,328 | 6/1991 | Bontrager | 206/523 |

FOREIGN PATENT DOCUMENTS

| | | | |
|---|---|---|---|
| 278113 | 4/1990 | German Democratic Rep. | 229/DIG. 1 |
| 127265 | 5/1990 | Japan | 206/521 |

*Primary Examiner*—David T. Fidei

*Attorney, Agent, or Firm*—Blakely, Sokoloff, Taylor & Zafman

[57] ABSTRACT

An apparatus and method for packaging an item, the apparatus comprising a single sheet of material comprised of a pliable padding substance. The sheet of material comprises at least one first cut, each at least one first cut being partway through the depth of the sheet of material. Each at least one first cut keeps at least one member attached to the sheet of material and allows each at least one member to rotate in a first direction about a first axis defined by material remaining at said first cut. The first cut keeps each at least one member attached to the sheet of material, and the at least one member rotates in a first direction to define a first pad adjacent to the item. The apparatus further comprises an orifice defined by the rotation of each at least one member, said orifice of suitable size to hold the item snugly. The apparatus comprises at least one second cut, each at least one second cut keeping at least one second member attached to said sheet of material and allowing the at least one second member to rotate in a second direction about a second axis defined by said at least one second cut in said sheet of material. The at least one second member rotates to define a second pad about the item. When folded, the at least one first and second members allow the apparatus to be packed inside a container, protecting the item from damage. In a preferred embodiment, the single sheet of material comprises polyurethane foam, and the item to be packaged is a hard disk drive.

13 Claims, 9 Drawing Sheets

FIG 4B
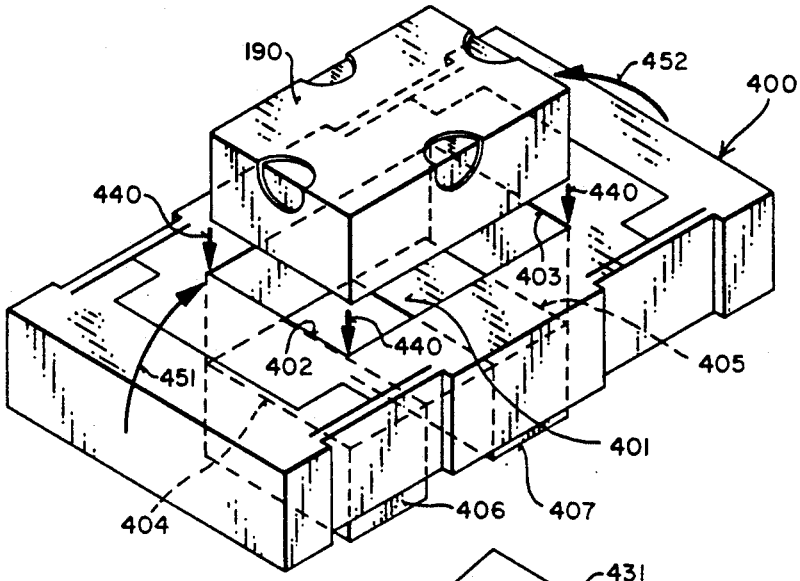
FIG 4C
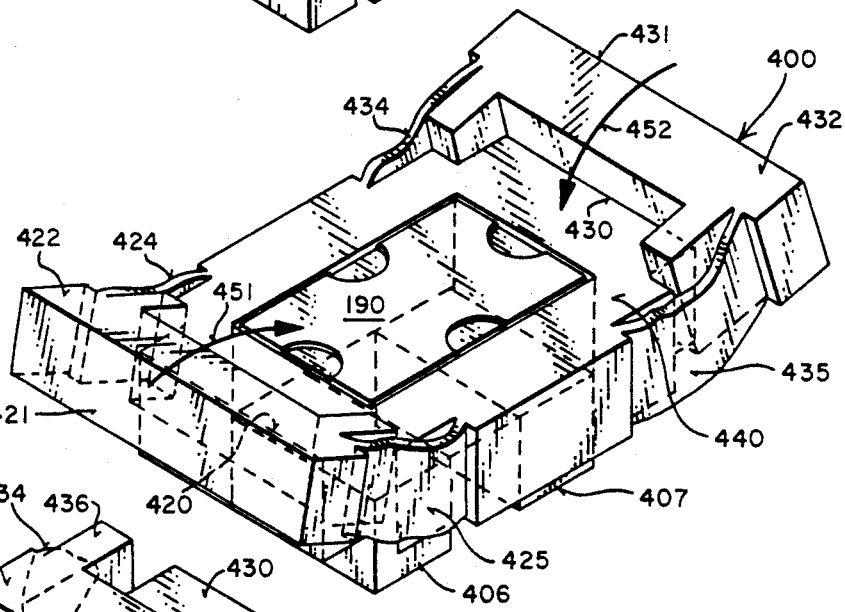
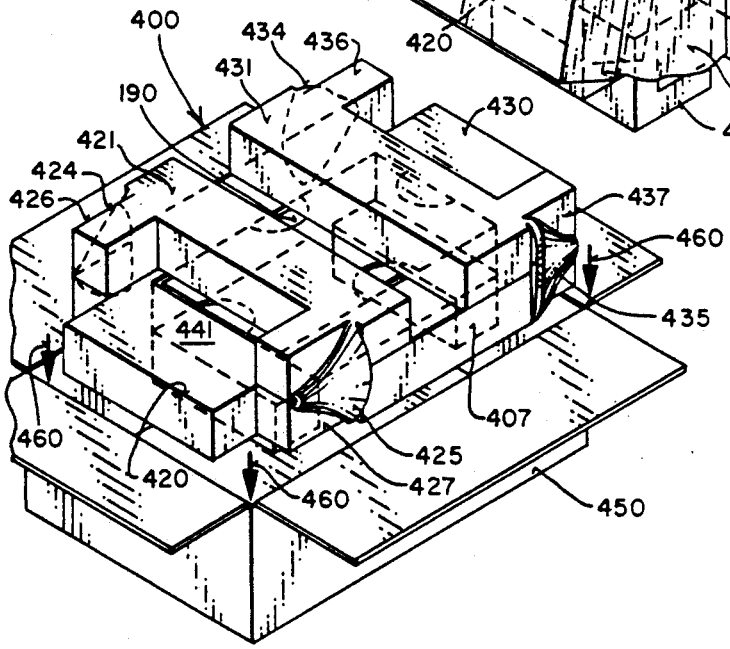
FIG 4D

FOLDABLE PACKAGING CUSHION FOR PROTECTING ITEMS

This is a continuation of application, now abandoned, Ser. No. 07/630,283, filed Dec. 19, 1990.

BACKGROUND OF THE INVENTION

1. Field of the Invention

The present invention relates to an apparatus and method for packaging. More particularly, this invention relates to a method and apparatus comprising a single piece of material, such as foam rubber, for packaging small fragile items such as hard disk drives.

2. Prior Art

In the past, packaging especially delicate electronic components such as hard disk drives or floppy disk drives, has typically been accomplished using some sort of foam material (such as polyurethane foam or polystyrene) or corrugated cardboard, or combinations of materials. Packing such components in these types of materials allows boxes containing the items to be dropped from a height of approximate 40 inches and not be damaged. Various prior art approaches are shown and discussed below in reference to FIGS. 1*a*–3*b*.

One prior art approach to packaging a component such as a hard disk drive, is shown in FIGS. 1*a*–1*d*. As shown in FIG. 1*a*, packaging 100 basically comprises a single piece of corrugated board 110 cut into an elongated cross-shape as shown in FIG. 1*a*. Attached to corrugated board 110 are four rectangular pieces of foam 121, 122, 123, and 124 which are attached to the underside of the corrugated board at equidistant intervals along the horizontal length of corrugated board 110. In addition, hexagonal foam pads 101, 102, 103, and 104 are attached to the upper side of corrugated board 110 as shown in FIG. 1*a*. As shown in FIG. 1*a*, pieces 101 through 104 are shaped so that when unit 100 is folded, as shown in FIG. 1*b*, they may be joined to form a box area 160 in the central region of corrugated board 110 to provide padding for an item placed at that location. This will be discussed with respect to the folding technique shown in FIGS. 1*b*–1*d*. As shown in FIG. 1*a*, foam pads 101 and 102 are folded at hinges 105 and 106 as indicated by arrows 150 and 151. Also, pads 103 and 104 are folded in towards the central region of corrugated board 110 along hinges 107 and 108. Pads 103 and 104 are folded in the directions shown as 152 and 153 on FIG. 1*a*. The result of this folding is shown in FIG. 1*b*. As shown in FIG. 1*b*, pads 101 through 104 form a central region 160 in corrugated board 110 so that a hard disk drive or other similar rectangular item may be placed and protected within region 160. Then, as shown in FIG. 1*b*, flaps 111 and 112 are folded in directions 161 and 162 respectively, to allow members 121 and 122 to cover the top portion of area 160. FIG. 1*b* illustrates how pads 123 and 124 support the bottom of area 160 with corrugated board 110 holding the material placed in the center of unit 110. The result of this folding operation of flaps 111 and 112 is shown in FIG. 1*c*.

As can be appreciated from viewing FIG. 1*c*, when flaps 111 and 112 are folded in directions 161 and 162 as shown in FIG. 1*b*, the completely folded unit 100 forms an enclosed and padded area 160 which can be used to protect a delicate item such as a disk drive. As discussed previously, when folded unit 100 is placed into a container such as a corrugated box, the product (e.g. drive unit 190, as shown in FIG. 1*d*), may withstand drops from a height of approximately 40 inches or greater. As shown in FIG. 1*d*, a 3-D perspective view of folded unit 100, including a disk drive unit 190 in the central region of folded unit 100, shows unit 100 thoroughly protected in every direction by foam pads 101 through 104 along the sides, by pads 123 and 124 along the bottom, and by pads 121 and 122 which protect the top portion of disk drive 190.

Although the combination of corrugated board 110 and foam pieces 101–104 and 121–124 presents an adequate method of protecting disk drives such as 190 placed in the central region of folded unit 100, the associated method of manufacturing is expensive and cumbersome. The main problem encountered with manufacturing such an item is that at least two different shapes of foam pieces must be manufactured, and a single piece of corrugated board must be cut and prefolded to a certain shape. After those component pieces of unit 100 have been manufactured, each individual piece (such as 101–104 and 121–124) must be separately affixed to corrugated 110 at precise locations using glue, or some other similar adhesive. Cutting the corrugated board into the appropriate shape to form base 110, and foam pieces 101–104 and 121–124 is relatively complicated and expensive. This is especially so for a unit which is typically disposed once the item being packaged and shipped arrives at its destination and is removed from the packing by the consumer. Therefore, it is desired that an improved packaging method and/or apparatus be created that is inexpensive, easy to manufacture, and simple to use.

Another prior art method and apparatus for packaging delicate items such as a disk drive is discussed with reference to FIGS. 2*a*–2*d*. As shown in FIG. 2*a*, prior art packaging unit 200 may be manufactured from a single piece of polyurethane foam which has been precut into four sections. These sections are cut into certain shapes for assembly in a predetermined way so that the entire package can fit within a container such as a corrugated board box. FIGS. 2*a*–2*d* illustrate how a main portion 201 of unit 200 forms the padding for the sides of the item to be packaged. Further, unit 200 comprises two bottom padding rails 202 and 203 which are affixed to the bottom portion 206 of main portion 201. This arrangement is better represented on FIG. 2*b* which shows a view from the bottom surface 206 of packaging unit 200. Rails 202 and 203 form the bottom padding for the area 208 in which the item to be packaged and potentially shipped, is placed. As is shown in FIG. 2*a*, unit 200 further comprises upper pads 204 and 205 which may be assembled to form the cushioning members for the top portion of unit 200. As can be seen in FIG. 2*a*, with rails 202 and 203 glued into place on main pad 201, pieces 204 and 205 may be temporarily attached to main unit 201 forming a unit for storage prior to assembly of the unit and packaging of an item. This method of assembly and packaging is discussed with reference to FIGS. 2*c* and 2*d*.

As shown in FIG. 2*c*, while main unit 201 is sitting in its upright position, that is with rails 202 and 203 resting on a flat surface, an item such as disk drive unit 190 may be inserted into orifice 208 in the direction indicated by arrows 210. Once 190 has been inserted, top pads 204 and 205 are put into place for padding unit 190 from the top as well as the sides and bottom. This is done by mating pads 204 and 205 so that pad 205 rests on top of pad 204. This operation is shown by moving 205 in the direction indicated by arrows 212, and mating notch 221 in pad 205 with notch 220 in pad 204. Then, assembled pads 204 and 205 may be moved in the direction shown as indicated by arrows 211 on FIG. 2c. This is done until members 230 and 231 of pad 204 are inserted into notches 232 and 233 of pad 201, respectively. Once these operations are complete, as shown in FIG. 2d, unit 200 forms a completely padded unit about item 190. The completely packaged unit shown in FIG. 2d may then be placed in a container such as a corrugated board box. This ensures that item 190, is padded from all sides, and is protected from damage.

Although unit 200 generally provides an effective means for protecting delicate items once assembled, unit 200 also requires costly manufacturing and assembly processes. As with item 100 shown in FIGS. 1a-1d, unit 200 is comprised of five unique shapes of polyurethane foam (201 through 205) which must be precut and partially assembled (i.e., hand glued) into a particular configuration prior to packaging. By way of example, members 202 and 203 must be affixed the lower surface 206 of main pad 201 using an adhesive or other similar means for affixing rails 202 and 203. This affixing of rails of 202 and 203 to unit 201 adds additional, costly steps to the manufacturing process.

Yet another prior art configuration is shown in FIGS. 3a and 3b. Unit 300 basically utilizes a "clam shell" approach which includes two separate portions 301 and 302. Portions 301 and 302 are usually identically constructed, each open central regions 311 and 310, respectively. When assembled, 301 and 302 define an interior open region into which a delicate item such as a hard disk drive may be placed and protected during storage and/or shipment within a container such as a corrugated board box. Clam shell units 301 and 302 are typically constructed of polystyrene using foam molding fabrication equipment. As is shown on FIGS. 3a and 3b, each clam shell comprises four arm type appendages 312 which extend out from the central region 311 as shown in FIGS. 3a and 3b. These appendages 312 should be approximately long enough for clam shell unit 300 to fit snugly within the sides of a corrugated board box for storage and/or shipment of an item such as 190. Further, each clam shell unit has feet member 313 which extend out from the orifice in the central region of clam shell units 301 and 302, forming the top and bottom of clam shell unit 300. This allows the unit to fit within a container from the top and bottom sides, while isolating unit 300 from any shocks caused by the dropping of unit 300 while within its container.

The assembly and use of clam shell 300 is simply illustrated in FIG. 3a and 3b. First, a unit such as 190 may be placed in a central region 310 of one of the clam shell units such as 302 shown in FIG. 3a. As discussed previously, 301 and 302 are manufactured with a depression 310 and 311 which will hold 190 in place. After this has been accomplished, clam shell 301 is moved in directions indicated by arrows 320 on FIG. 3a, thus closing the clam shell and securing 190 within unit 300. The result of this operation is shown in FIG. 3b. Unit 300 shown in FIG. 3b may be placed into a container of the requisite dimensions as defined by appendages 312 and pegs 313 radiating out from unit 300 so that 190 may be protected for storage and/or shipment within clam shell 300. As with the items illustrated in FIGS. 1a-2d, clam shell unit 300 requires manufacturing the clam shell portions 301 and 302 into very specific shapes using polystyrene molding equipment. This equipment and materials for this process are not inexpensive. In addition, clam shell units 301 and 302 must be manufactured to very specific dimensions according to the container size and the size of unit 190 which will be transported within clam shell 300. Utilizing a different size container will require a different mold for clam shell 300. Manufacturing different sized clam shells, requires expensive retooling and manufacturing.

In view of the expensive manufacturing cost of packaging for delicate components such as hard disk drives as shown in FIGS. 1a-1d, 2a-2d, and 3a and 3b, a more simple and cost effective type of packaging is required which will allow delicate items to be shipped without damage within a suitable container.

SUMMARY AND OBJECTS OF THE INVENTION

One object of the invention is to provide a relatively simple apparatus to manufacture which will provide protection for delicate items during storage and/or shipment.

Another object of the present invention is to provide an item which requires little or no assembly to provide protection for an item during storage and/or shipment.

These and other objects of the invention are provided for by an apparatus and method for packaging an item, the apparatus comprising a single sheet of material comprised of a pliable padding substance. In a preferred embodiment, the pliable padding substance comprises polyurethane foam rubber, and the item is a hard disk drive. The sheet of material comprises at least one first cut, each at least one first cut being partway through the depth of the sheet of material. Each at least one first cut keeps at least one member attached to the sheet of material and allows each at least one member to rotate in a first direction about a first axis defined by material. The first cut keeps each at least one member attached to the sheet of material, and the at least one member rotates in a first direction to define a first pad adjacent to the item. The apparatus further comprises an orifice defined by the rotation of each at least one member, said orifice of suitable size to hold the item snugly. The apparatus comprises at least one second cut, each at least one second cut keeping at least one second member attached to said sheet of material and allowing the at least one second member to rotate in a second direction about a second axis defined by said at least one second cut in said sheet of material. The at least one second member rotates to define a second pad about the item. When folded, the at least one first and second members allow the apparatus to be packed inside a container, protecting the item from damage.

BRIEF DESCRIPTION OF DRAWINGS

FIGS. 4a-4d show the method and apparatus of the preferred embodiment for packaging an item for shipment and/or storage within a container.

DETAILED DESCRIPTION OF THE PREFERRED EMBODIMENT

A method and apparatus for packaging delicate items, including hard disk drives, floppy disk drives, and other similar items, is described. In the following description, for the purposes of explanation, specific materials, and components that are packaged, are set forth in order to provide a thorough understanding of the present invention. It will be apparent, however, to one skilled in the art that the present invention may be practiced without these specific details.

Figure 1A:
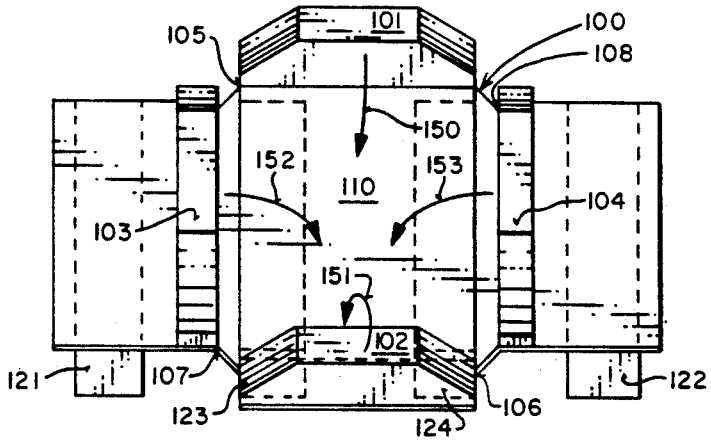
FIG 1A (PRIOR ART)
FIGS. 1a-1d show a prior art apparatus for packaging an item and placing that packaged item into a container such as a corrugated board box.
Figure 1B:
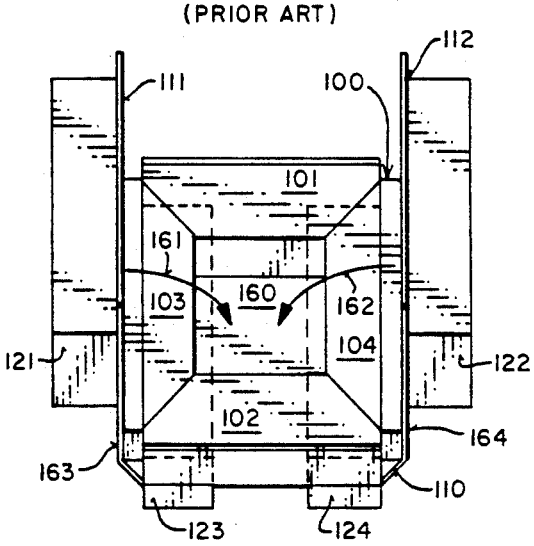
FIG 1B (PRIOR ART)
Figure 1C:
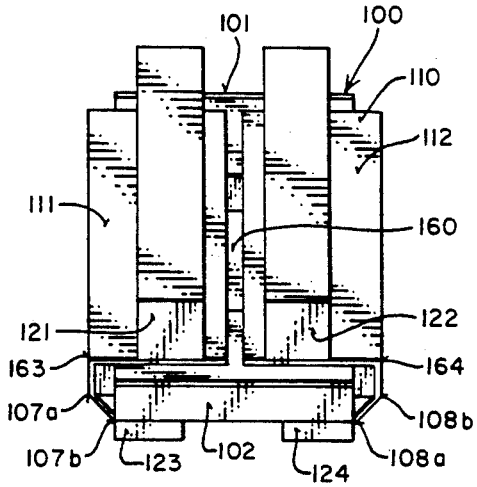
FIG 1C (PRIOR ART)
Figure 1D:
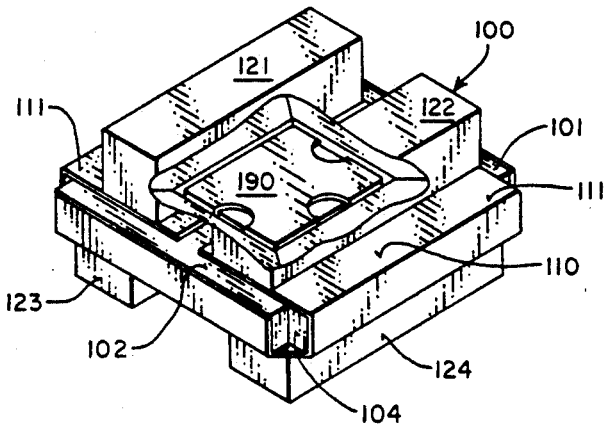
FIG 1D (PRIOR ART)
Figure 2A:
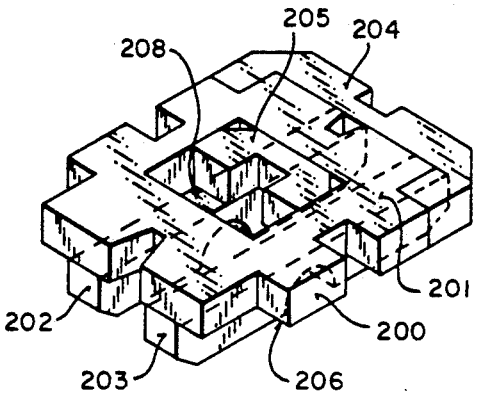
FIG. 2A (PRIOR ART)
FIGS. 2a-2d show another prior art method and apparatus for packaging an item for shipment and/or storage within a container.
Figure 2B:
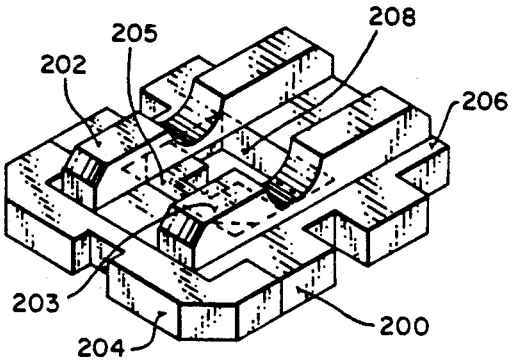
FIG. 2B (PRIOR ART)
Figure 2C:
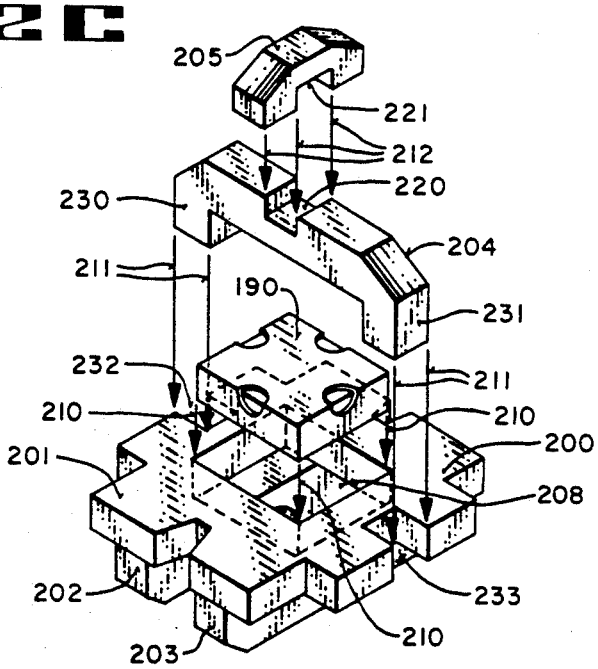
FIG. 2C (PRIOR ART)
Figure 2D:
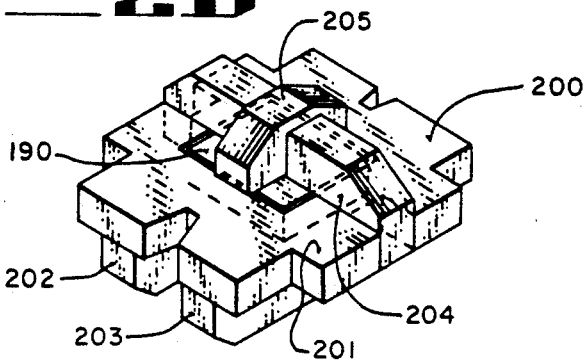
FIG. 2D (PRIOR ART)
Figure 3A:
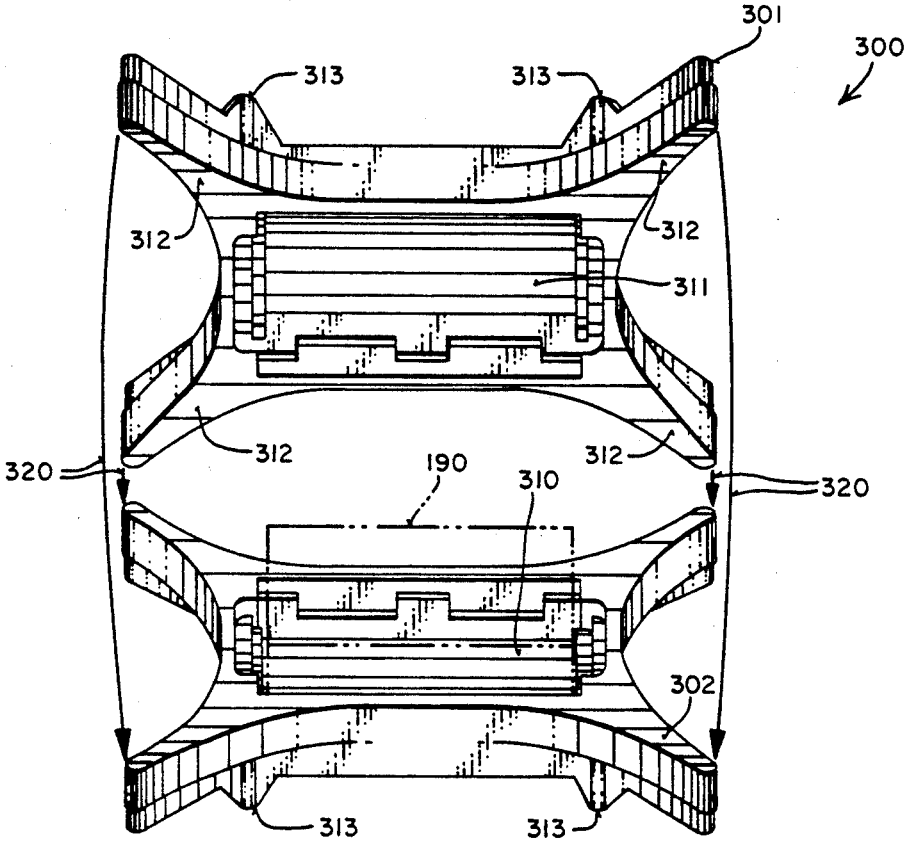
FIG 3A (PRIOR ART)
FIGS. 3a and 3b show a third prior art method and apparatus for storing and/or shipping an item within a container.
Figure 3B:
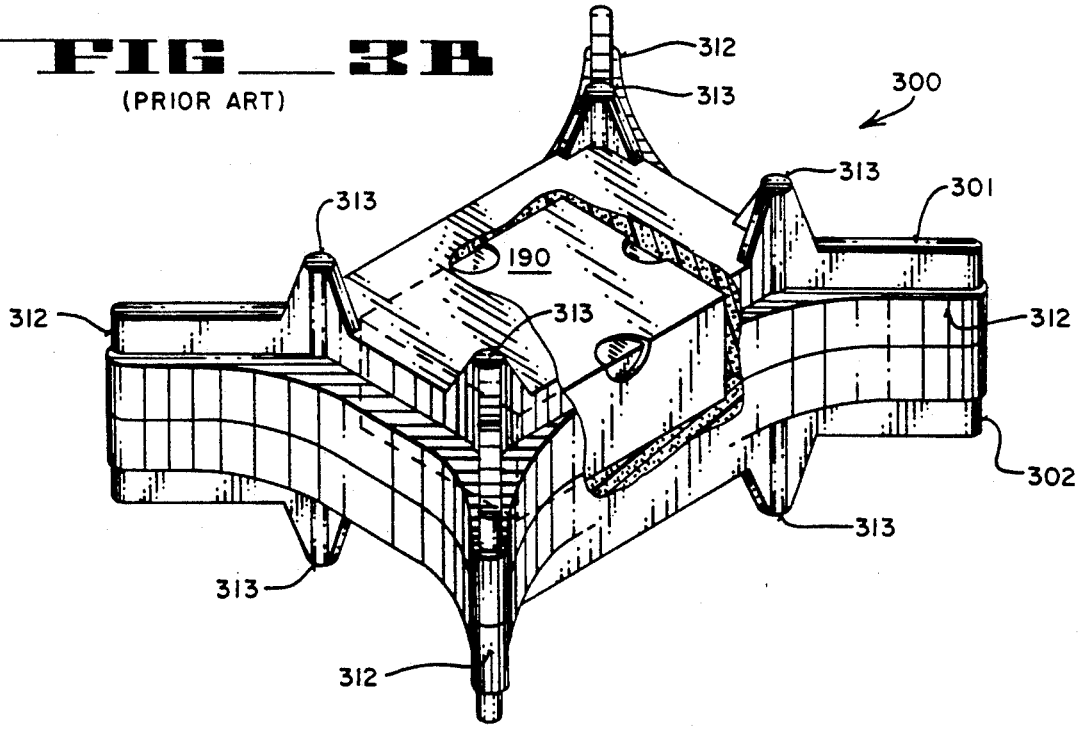
FIG 3B (PRIOR ART)
Figure 4A:
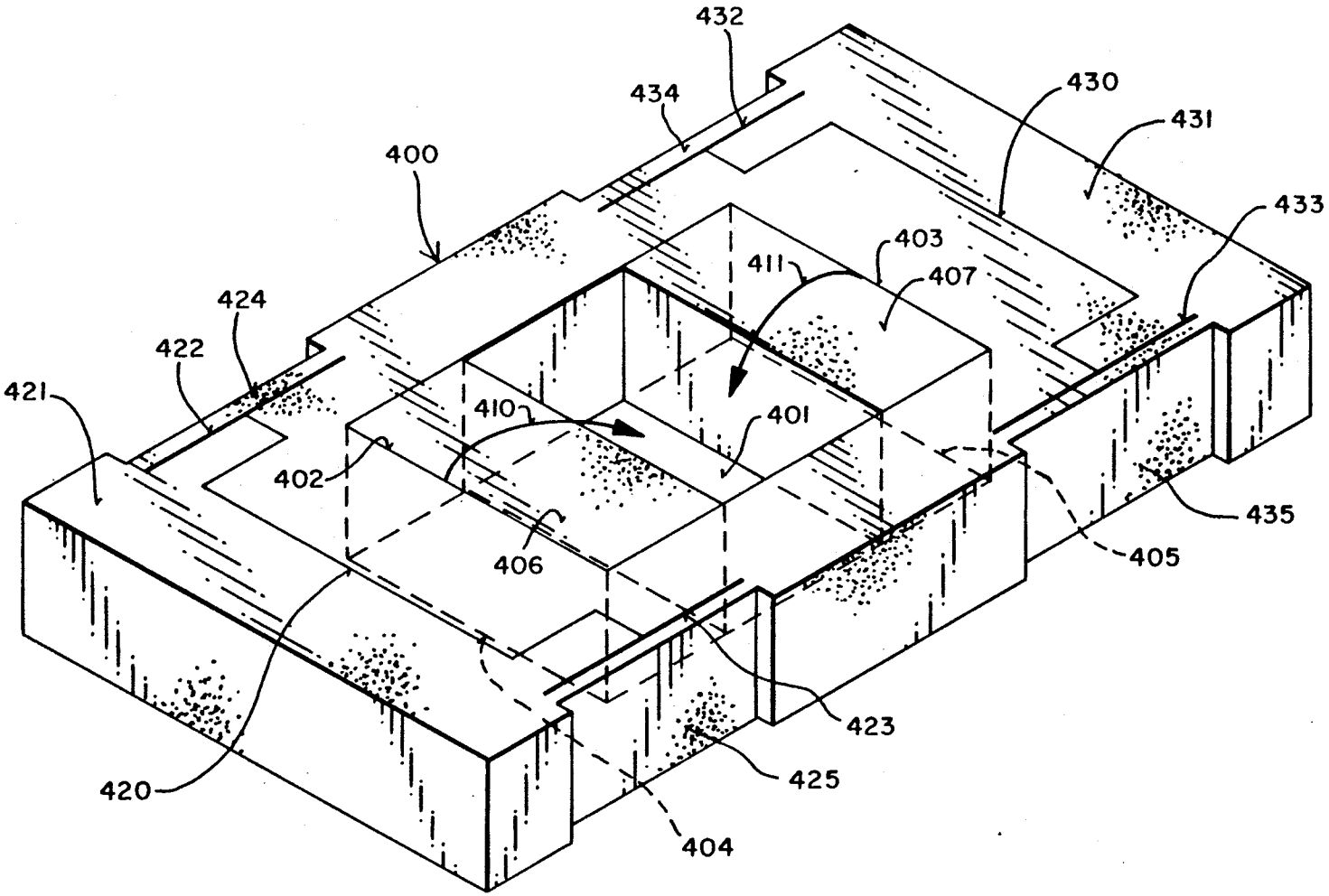

Referring to FIGS. 4*a*–4*d*, the apparatus used in the present invention is shown as 400. Padding 400 basically comprises a single sheet of polyurethane ether foam type N95 of a density 1.7±2. In the preferred embodiment, Great Western Foam of type IFD 90 to 95 is used in order to provide adequate cushioning for components such as hard disk drives and floppy disk drives to be packaged in foam 400. As shown in FIG. 4*a*, 400 is comprised of a single rectangular sheet of polyurethane foam approximately 2.25 inches in dept, 9 inches in width, and 15.5 inches in length. These dimensions are set forth for the purposes of discussing the preferred embodiment and do not limit the scope of the present invention. Unit 400 is cut into the shape as shown in FIG. 4*a* using a urethane foam press which compresses unit 400 and makes incisions using sharp knife blades such as an Exacto brand precision knife. 400 has a central region 401 which is rectangular in shape and whose foam has been removed. 401 has been cut for the width and shape of the item which is to be packaged. Essentially, 400 is a rectangular sheet of polyurethane foam with precision cuts in it. As shown in FIG. 4*a*, all the cuts shown are completely through the material comprising 400 with the exception of cuts 402 and 403. 402 and 403 are cuts which penetrate approximately 75% of the way through the 2.25 inch material. Therefore, since there is a slight amount of material remaining at points 404 and 405 shown in FIG. 4*a*, pieces 406 and 407 are still attached to unit 400. The remaining material left at areas 404 and 405, operate as hinges for pads 406 and 407 so that pads 406 and 407 may be folded in the directions indicated by arrows 410 and 411 as shown in FIG. 4*a*.

As can be appreciated from viewing FIG. 4*a*, the remainder of the cuts in 400 such as 420, 422, 423, 430, 432 and 433 are completely through the material. 424, 425, 434, and 435 also operate as hinges upon which pieces 421 and 431 may move, however, in a different way than 404 and 405. The use of unit 400 is discussed with reference to FIGS. 4*b*–4*c*.

First, pieces 406 and 407 are folded in the directions indicated by arrows 410 and 411 as shown in FIG. 4*a*. Pieces 406 and 407 then form the bottom of the folded unit 400 which will be used to store a hard disk drive unit 190 as shown in FIG. 4*b*. As shown in FIG. 4*b* with 406 and 407 folded in the "down" position, an item such as disk drive unit 190 may be lowered into orifice 401 in the directions indicated by arrows 440. Once disk drive 190 is inserted in orifice 401, it is held snugly there due to the shape of orifice 401 being the approximate size as disk drive package 190. As shown in FIG. 4*b*, once inserted, disk drive unit 190 is supported in place by foam rails 406 and 407. 406 and 407 are kept in place by the remaining material left at positions 404 and 405 since cuts 402 and 403 only extend partway through the depth of unit 400. As shown in FIG. 4*c*, once disk drive 190 is inserted into orifice 401 and is resting upon rails 406 and 407, pads 421 and 431 may be folded in the directions indicated by arrows 451 and 452. As discussed previously, because material 424, 425, 434, and 435 continue to attach bumpers 421 and 431 to the remainder of unit 400, 424, 425, 434, and 435 act as "hinges" upon which bumpers 421 and 431 may rotate. Cuts 420 and 430 are the axes of rotation for bumpers 421 and 431, respectively. 421 and 431 both continue to be rotated in the directions shown as 451 and 452 on FIG. 4*c* until the top surfaces of 421 and 431, 422 and 432, respectively, touch the top surface portion 440 of the remainder of unit 400. 421 and 431, when moved into this position, act as padding for the top of item 190 residing in unit 400. This is shown in FIG. 4*d*.

As shown in FIG. 4*d*, once upper bumpers 421 and 431 have been folded into place above unit 190, the folded unit 400 is ready for placement into a container such as corrugated board box 450 shown in FIG. 4*d* by inserting unit 400 in the direction as indicated by arrows 460. As is shown, hinges 424, 425, 434 and 435 are folded over onto themselves. As can be appreciated from FIG. 4*d*, when folded in this manner in preparation for insertion into a container 400, grooves 426, 427, 436, and 437 are cut to provide proficient clearance between the folded hinges 424, 425, 434, and 435 and the sides of box 450, to insert the folded 400 in container 450.

Figure 4E:
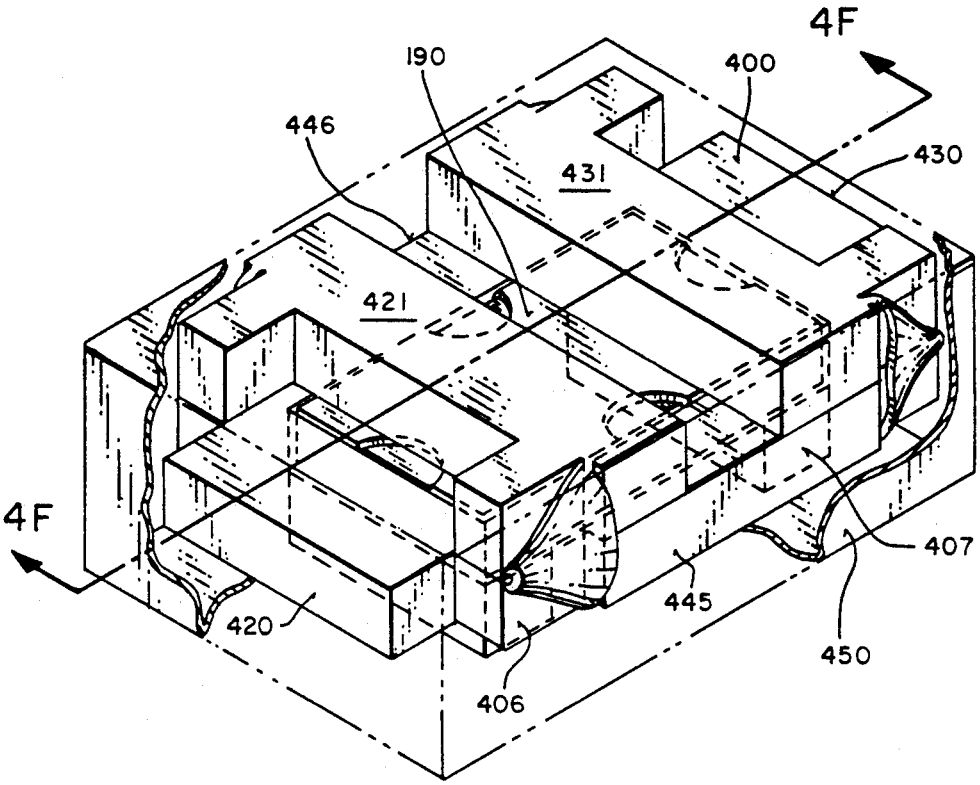
FIG. 4e shows the complete folded unit of the preferred embodiment with an item such as a hard disk drive contained within it for shipment and/or storage.
Figure 4F:
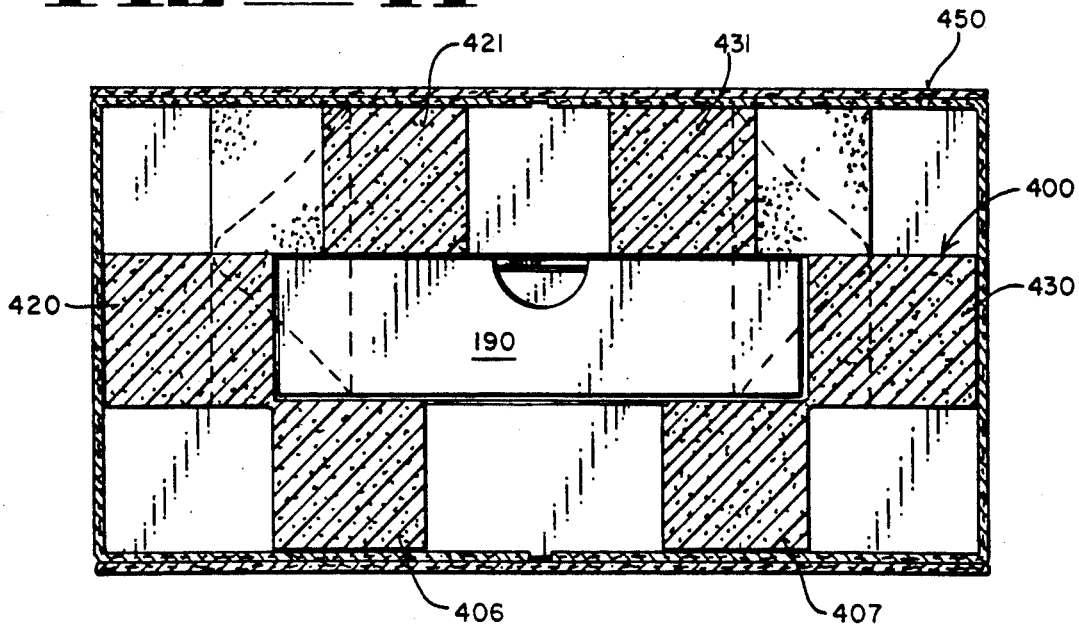
FIG. 4*f* shows a side cutaway view of the packaging of the preferred embodiment which contains an item and has been placed within a corrugated board box.

As can be appreciated from FIG. 4*e*, once unit 400 is inserted into box 450, it is held snugly in place by bumpers 421 and 431, lower bumpers 406 and 407, and around the sides of the box by edges 420 and 430 and front and back edges 445 and 446. This prevents any shifting of unit 400 while inside container 450. As shown in FIG. 4*f*, a side cutaway view of a packed box 450 with unit 400 and item 190, bumpers 421 and 431 hold unit 190 snugly in place from the top, 406 and 407 hold unit 190 snugly from the bottom, and edges 420 and 430 prevent any sideways shifting of 190 within box 450.

As has been discussed with reference to FIGS. 4*a*–4*f*, unit 400 provides a convenient and low cost solution for the packaging of delicate items, including hard and floppy disk drive units. When an item has been packaged using 400 and placed into a container, such as a corrugated board box 450 as shown in FIG. 4*e*, the item may be shipped and/or stored while ensuring that the unit is not damaged in any way. Box 450, along with unit 190 shown in FIG. 4*e*, due to unit 400's resilient suspension within box 450, may be dropped from a height of approximately 40 inches without damage occurring to unit 190. As such, apparatus 400 provides the same protection as the prior art packaging shown in FIGS. 1*a*–3*b*, however, packaging 400 is more cost effective than the prior art approaches. The cost of manufacturing item 400 is substantially reduced because it is comprised of a single piece of polyurethane foam and the foam may be manufactured in the shape and with the incisions shown in FIGS. 4a–4f in one simple operation by compressing the square piece of foam and making complete knife cuts through the material (except for 402 and 403) as shown in FIG. 4a. In addition, these cuts in the material may be made all from one direction when manufacturing 400 and, therefore, it may be manufactured in one step. No additional steps of manufacturing other parts, assembly or gluing needs to be done, as in the prior art approaches shown in FIGS. 1a to 3b. The cost of the foam in conjunction with the simple task of manufacturing unit 400 makes unit 400 a cost effective solution for packaging, because the packaging is sometimes disposed of after only one use. In addition, only one type of material is required, in contrast to the prior art approach shown in FIGS. 1a–1d.

Figure 5A:
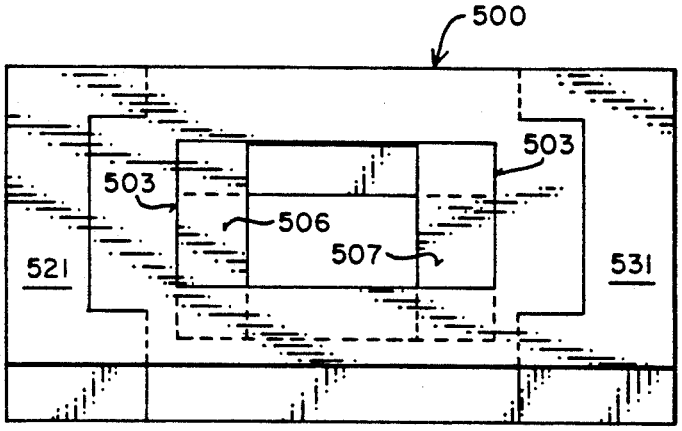
FIGS. 5*a*–5*f* show an alternative embodiment method and apparatus for packaging a delicate item such as a hard disk drive within a container for shipment and/or storage.
Figure 5B:
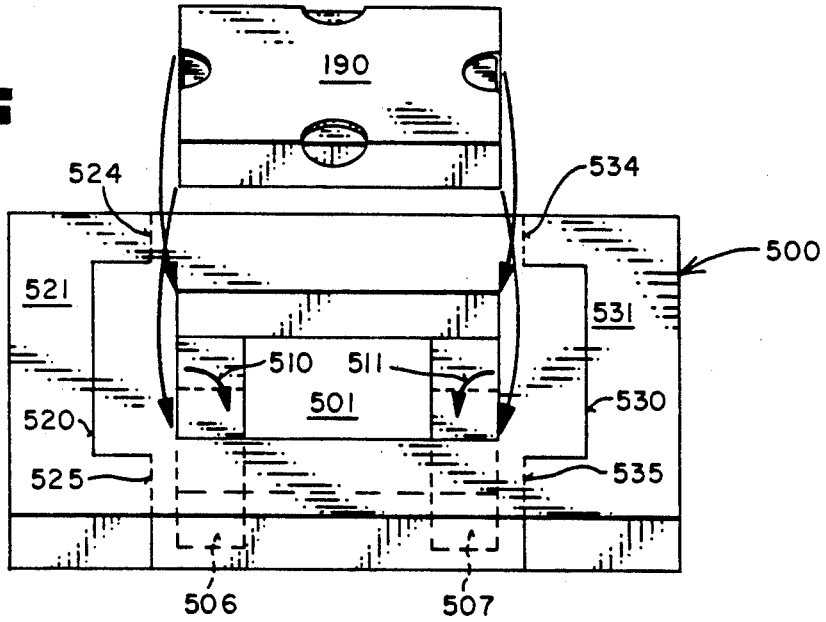
Figure 5C:
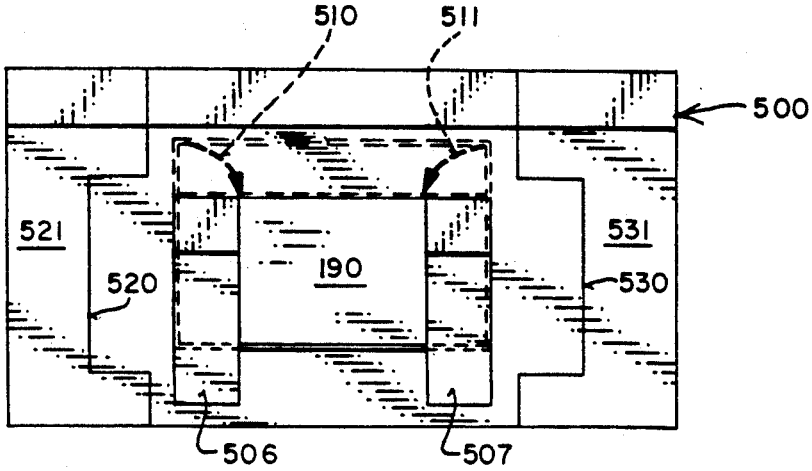
Figure 5D:
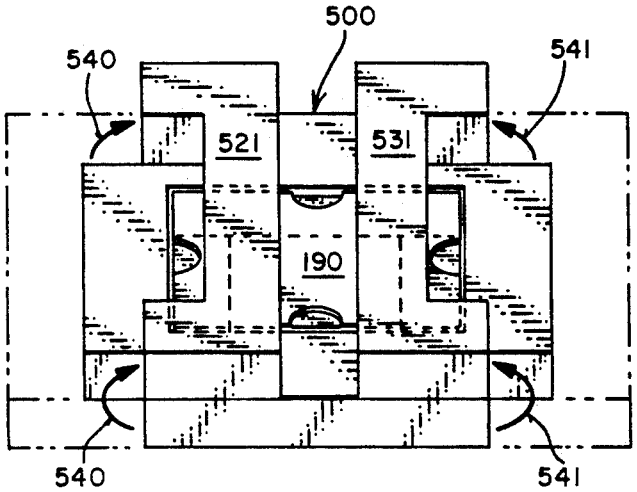

An alternative embodiment of the present invention is shown and discussed with reference to FIGS. 5a–5g. Unit 500 shown in FIG. 5a is also comprised of polyurethane ether foam. As with unit 400, two lower pads 506 and 507 are attached via partial cuts 502 and 503 into the material to allow them to fold in a downward direction as indicated by the arrows 510 and 511 shown in FIG. 5b. As shown in FIGS. 5a–5f, similarly to unit 400 in FIGS. 4a–4f, numerous cuts are made in the foam which comprises unit 500. Similar to unit 400, all of these cuts penetrate the foam material completely except for cuts 502 and 503, and cuts 524, 525, 534, and 535. Cuts 502 and 503 like 402 and 403 of the preferred embodiment allow 506 and 507 to fold in a downward direction as shown in FIG. 5b. Partial cuts 524, 525, 534 and 535 are made from the opposite side of unit 500 as cuts 502 and 503 and allow pads 521 and 531 to swing in upward directions 540 and 541 as shown in FIG. 5d. This allows top bumpers 521 and 531 to swing upwards and rest on top of an inserted unit 190 as shown in FIG. 5d. 524, 525, 534, and 535 act as hinges for top bumpers 521 and 531.

Figure 5E:
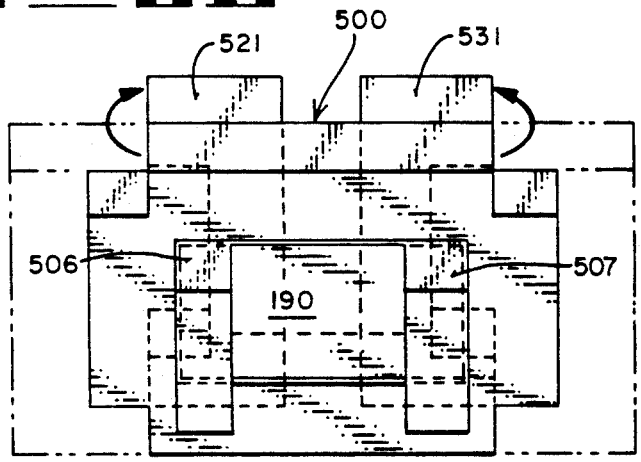
Figure 5F:
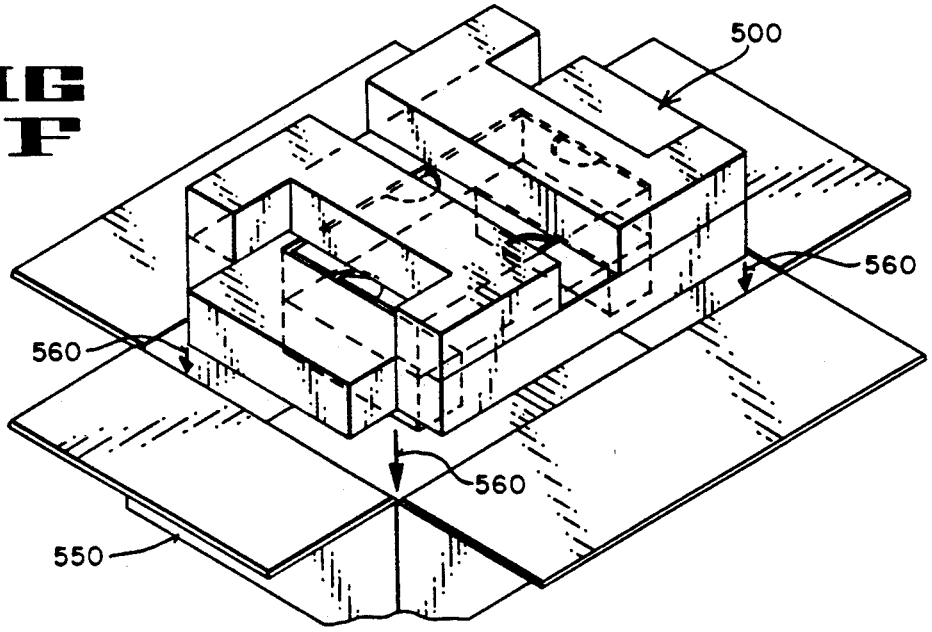
Figure 5G:
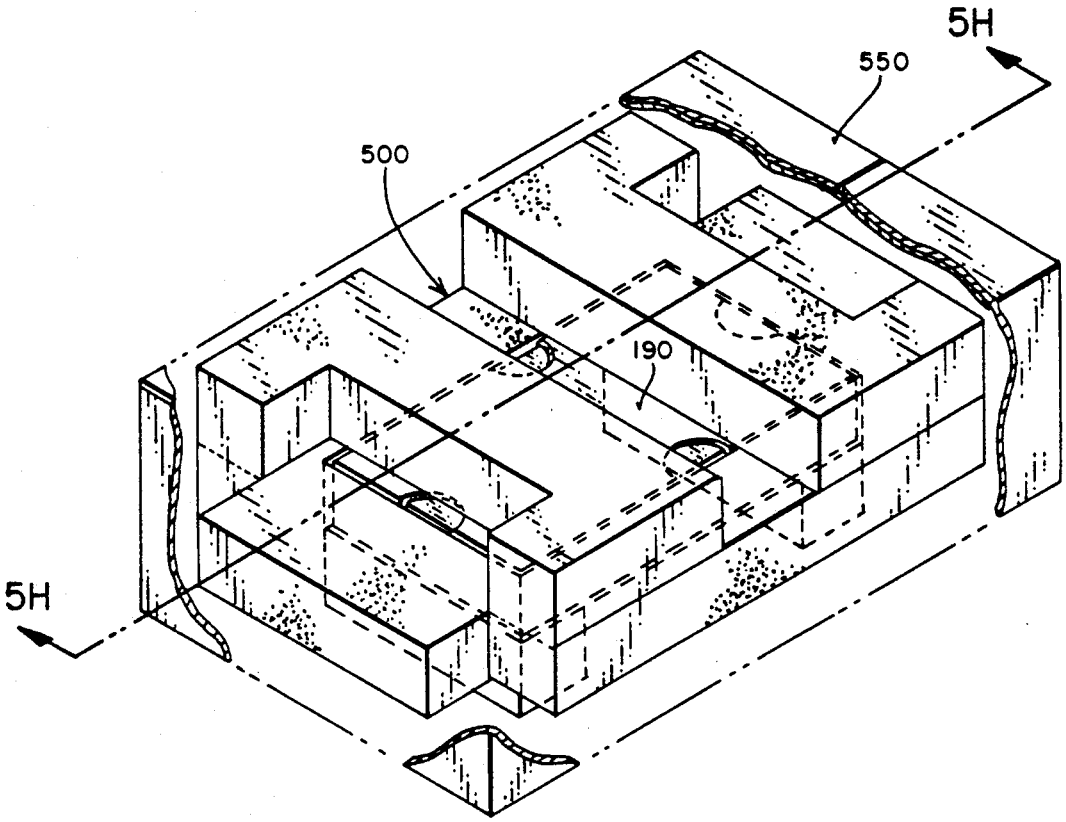
FIG. 5*g* is a perspective view of the alternative embodiment.
Figure 5H:
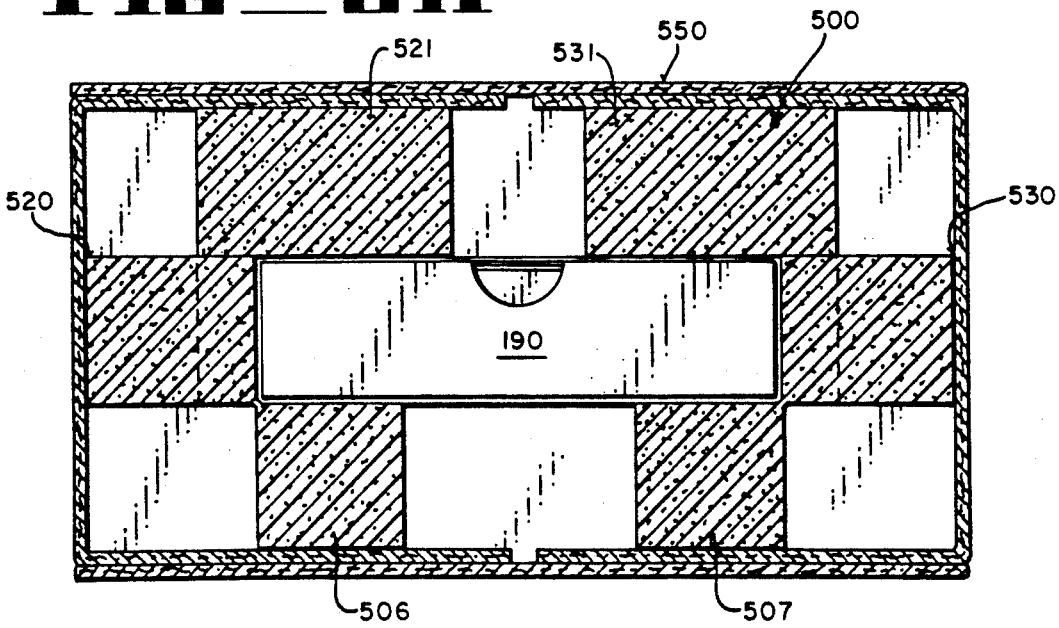
FIG. 5*h* shows a cutaway view of the completed and folded alternative embodiment.

The operation of unit 500 is similar to the operation of unit 400. As shown in FIG. 5b, once 506 and 507 have been folded in the direction shown as 510 and 511 in FIG. 5b, a delicate item, such as disk drive unit 190, may be inserted into orifice 501. This allows 190 to sit snugly within orifice 501 and rest upon lower bumpers 506 and 507. Once this has been done, as shown in FIG. 5d, bumpers 521 and 531 may be folded in the directions indicated by 540 and 541 to complete the folding and enclose 190 within unit 500. A lower view of 190 while enclosed within unit 500 is shown in FIG. 5e. Once unit 190 is completely enclosed within unit 500, 500 may be lowered into a container such as a corrugated board box 550 in the direction shown as 560 on FIG. 5f. As shown in FIG. 5g, once this has been accomplished, 190 is protected from all directions due to the snug fit of unit 500 within box 550. As with unit 400 discussed above, unit 500 will provide protection for item 190 if box 550 is dropped from up to a 40 inch height protecting it from impact from any direction. A cross section of unit 500 while inserted in box 550 is shown in FIG. 5h. Again, as discussed with reference to unit 400 and FIGS. 4a–4f, as shown in FIG. 5h, unit 500 provides complete enclosure for item 190 because of the snug fit of lower bumpers 506 and 507, upper bumpers 521 and 531 and edges 520 and 530 within box 550. This prevents any shifting or movement of unit 190 within box 550 thus preventing it from being damaged while in transit.

Thus, a method and apparatus for packaging an item has been described. Although the present invention as described particularly with reference to FIGS. 1a–5h, it will be apparent to one skilled in the art that the present invention has utility for art exceeding that disclosed in the Figures. It is contemplated that many changes and modifications may be made by one of ordinary skill in the art, without departing from the spirit and scope of the invention as disclosed above.

What is claimed is:

1. An apparatus for completely enclosing and packaging an item, said apparatus having a single sheet of material, said single sheet of material comprising opposed ends and opposed sides, and a top and a bottom, the distance between said top and bottom being approximately equal to the depth of said item, the distance between said ends being greater than the distance between said opposed sides, said single sheet of material further comprising:

a. two first cuts from the top of said sheet of material in a central portion of the sheet of material aligned parallel with said opposed ends, said first cuts being partially through the depth of the material to create first hinges parallel with said opposed ends, said first hinges attaching first members to said sheet of material and allowing said first members to rotate to a first position on the bottom side of said material, said first position of said first members creating a first pad on a bottom side of said item;

b. a void created in the central portion of the sheet of material caused by the rotation of said first members to the first position, said void allowing the insertion of the item such that the remaining portion of the sheet of material holds the item snugly and forms a pad around the item in the lateral directions; and c. two pairs of second cuts from said top aligned parallel and adjacent with said opposed sides, and third cuts perpendicular to and connecting each of said pairs of second cuts, said second and third cuts creating second members at the opposed ends of the sheet of material and second hinges which allow said second members to rotate to the top side of said sheet of material creating a pad on a top side of the item when said item is inserted into said void.

2. The apparatus of claim 1 wherein the second cut is completely through the sheet of material.

3. The apparatus of claim 1 wherein the single sheet of material comprises polyurethane foam.

4. The apparatus of claim 1 which comprises two first cuts and two second cuts.

5. A blank formed of a material to act as a cushion to protect a fragile item when said blank is folded and receives said fragile item to protect said fragile item during shipping comprising:

a. a block of material having opposed ends and opposed sides extending between said ends and having front and rear surfaces wherein the thickness of said material between said front and rear surfaces corresponds to at least the thickness of said fragile item, and the length of said block between said ends being greater than the width of said block between said sides;

b. said block being formed with two first cuts parallel to said ends from said front surface, said first cuts terminating prior to the sides of said block and terminating prior to said rear surface of said block and forming two hinges upon which two first leg members may rotate outward from said block towards said rear surface and define a central cavity region in said block; and c. said block further being formed with two pairs of second cuts parallel to said sides at each of said ends, said second cuts terminating prior to said ends, and third cuts perpendicular to said two pairs of second cuts and connecting each pair of said two pairs of second cuts, said second and third cuts extending from said front to said rear surface and defining two hinges upon which two second leg members may rotate outward from said block towards said front surface such that when said first leg members are rotated to form said central cavity in said block, said fragile item is inserted into said cavity and said second leg members are rotated said block forms a cushion about the ends, sides and front and rear surfaces of said fragile item.

6. The blank of claim 5 which is comprised of a single piece of polyurethane foam.

7. The blank of claim 5 which is comprised of a lightweight foam packing material which is resilient and easily cut to form said blank.

8. The blank of claim 5 further comprising indentations in said sides parallel with said two pairs of second cuts to allow said hinges to fold and occupy said indentations when said fragile item is inserted into said cavity and said second leg members are rotated.

9. The blank of claim 5 further comprising a removable plug which is cut to define said central cavity in addition to said first leg members.

10. A blank formed of a material to act as a cushion to protect a fragile item when said blank is folded and receives said fragile item to protect said fragile item during shipping comprising:

a. a block of material having opposed ends and opposed sides extending between said ends and having front and rear surfaces wherein the thickness of said material between said front and rear surfaces corresponds to at least the thickness of said fragile item, and the length of said block between said ends being greater than the width of said block between said sides;

b. said block being formed with two first cuts parallel to said ends from said front surface, said first cuts terminating prior to the sides of said block, terminating prior to said rear surface of said block and forming two hinges upon which two first leg members may rotate outward from said block towards said rear surface and define a central cavity region in said block; and c. said block further being formed with two second cuts parallel to said ends from said rear surface, said second cuts extending between the two sides of said block and terminating prior to the front surface of said block, said second cuts defining two hinges upon which two second leg members may rotate outward from said block towards said front surface such that when said first leg members are rotated to form said central cavity in said block, said fragile item is inserted into said cavity and said second leg members are rotated said block forms a cushion about the ends, sides and front and rear surfaces of said fragile item.

11. The blank of claim 10 which is comprised of a single piece of polyurethane foam.

12. The blank of claim 10 which is comprised of a lightweight foam packing material which is resilient and easily cut to form said blank.

13. The blank of claim 10 further comprising a removable plug which is cut to define said central cavity in addition to said first leg members.

* * * * *